US005584383A

United States Patent [19]

Matsuo et al.

[11] Patent Number: 5,584,383

[45] Date of Patent: Dec. 17, 1996

[54] OPERATING MECHANISM FOR CIRCUIT BREAKER

[75] Inventors: Kazuhiro Matsuo; Makoto Taniguchi; Junji Fujiwara; Takayuki Miyazawa, all of Tokyo, Japan

[73] Assignee: Kabushiki Kaisha Toshiba, Kanagawa-ken, Japan

[21] Appl. No.: 311,339

[22] Filed: Sep. 23, 1994

[30] Foreign Application Priority Data

Sep. 24, 1993 [JP] Japan ..... 5-237058

[51] Int. Cl.[6] ..... H01H 5/00

[52] U.S. Cl. ..... 200/400; 200/402; 185/40 R

[58] Field of Search ..... 200/400, 401, 200/402; 185/40 R

[56] References Cited

U.S. PATENT DOCUMENTS

| | | | |
|---|---|---|---|
| 4,578,551 | 3/1986 | Lin | 200/400 |
| 4,996,397 | 2/1991 | Kuhn et al. | 200/144 |
| 5,226,528 | 7/1993 | Schaffer | 200/400 |

FOREIGN PATENT DOCUMENTS 88-10943 8/1988 France .

5-54762 3/1993 Japan .

*Primary Examiner*—David J. Walczak

*Attorney, Agent, or Firm*—Limbach & Limbach

[57] ABSTRACT

An operating mechanism for a circuit breaker including a frame, a spring shaft mounted on the frame and rotatable around a central axis thereof, a spring case having a notch in an outer periphery thereof and rotatable around the central axis, a rotating spring provided in the spring case and having a first end secured to the spring shaft and a second end secured to the spring case, a cam secured to the spring shaft and rotatable along with the spring shaft, and a catch rotatably mounted on the spring case. The catch is at an original position at the notch inside the outer periphery of the spring case by a spring. The operating mechanism further includes a charging device for rotating the spring case to charge the rotating spring and a control lever rotatably mounted on the frame and having an end portion engaged with the cam, the catch and the outer periphery of the spring case for performing closing and opening control of the charging device. The spring shaft is rotated by a driving force of the rotating spring for causing the control lever to perform the closing control of the charging device. The spring case is rotated by the charging device to charge the rotating spring for causing the control lever to perform the opening control of the charging device.

5 Claims, 10 Drawing Sheets

OPERATING MECHANISM FOR CIRCUIT BREAKER

BACKGROUND OF THE INVENTION

1. Field of the Invention

This invention relates to a circuit breaker and more particularly to an operating mechanism for a circuit breaker wherein a rotating spring is used as an energy source.

2. Description of the Related Art

Among circuit breakers which use rotational torque output mechanisms as their operating mechanisms, there are some which use a compression coil spring such as disclosed in Laid-Open Patent Heisei 5-54762. However, a variety of studies have been promoted to design better compactization and higher reliability.

A circuit breaker is used for protecting a power system by opening and closing the contacts provided in the circuit breaker. FIG. 8 shows a cross section of a typical vacuum circuit breaker 100. In FIG. 8, a spring mechanism (not shown) is provided in an operating mechanism unit 102 mounted on a frame 105 of vacuum circuit breaker 100 as one of the energy sources for opening and closing the contacts 103, in a breaker unit 101. Operating mechanism unit 102 generates a driving force to open and close contacts 103, 104. Besides, it is required for operating mechanism unit 102 to function to display the opening/closing state of contacts 103, 104, the discharge/charge state of the spring mechanism and so on. Charging the spring mechanism is usually executed by an electric motor (not shown) in operating mechanism unit 102. Operating mechanism unit 102 is also provided with a mechanism (not shown) for charging the spring mechanism manually.

Usually, a compression coil spring or a tension coil spring is used as the spring mechanism in operating mechanism unit 102. In this case, it is required to provide two springs separately for closing and opening contacts 103, 104 in operating mechanism unit 102, and this results in complex construction. In the case that a rotating spring is used as the spring mechanism for the energy source, only one rotating spring is required for both closing and opening contacts 103, 104 in operating mechanism unit 102, and this results in simple and compact construction.

Accordingly, a rotating spring has been used for the energy source in an operating mechanism of a circuit breaker.

Next, control of an electric motor for charging a rotating spring in connection with the opening/closing operation of the contacts is described with reference to FIG. 9. Generally, a circuit breaker is required to provide with the function to "open—close—open" the contacts. This is because a circuit breaker is usually operated to "open—close" the contacts, but it is necessary to "open" the contacts immediately when a fault takes place in a power system at the time of closing the contacts.

In the normal opening—closing operation of the circuit breaker, the energy generated by a rotation of the rotating spring is used for opening—closing the contacts. After the closing the contacts, a limit switch is operated to start operation of the electric motor so as to charge the rotating spring. After that, when the energy sufficient to open—close the contacts is charged again in the rotating spring, the limit switch is opened thereby the electric motor is stopped.

Hereinafter, a typical example of such a circuit breaker which uses a rotating spring, such as a spiral spring or a torsion spring in an operating mechanism is described in detail with reference to the drawings.

FIG. 10 is an enlargement of the essential parts of an operating mechanism of a circuit breaker which uses a rotating spring. In FIG. 10, (a) shows an enlarged front elevation of the essential parts and (b) shows a section, taken along lines A—A and in the direction of the arrow A in FIG. 10(*a*). In FIG. 10, the outer end of a rotating spring 21 which is an energy source is secured to a spring case 20, and the inner end of rotating spring 21 is secured to a spring shaft 22 which transmits the force. Also, a disc 23 is secured on spring shaft 22. Rail 23*a* which makes sliding contact with a peg 24 is positioned on the inner face of disc 23, and peg 24 controls release/store control lever 25. Parallel Guides 20*a* provided in the radial direction of spring case 20 are positioned on an end-plate disc 20*b* of spring case 20 so that peg 24 can move along parallel guides 20*a*.

The following is a description of the operation of the circuit breaker shown in FIG. 10, using FIG. 11. Peg 24 engages with rail 23*a*, and performs a translational motion in parallel guides 20*a* due to the rotational motion of disc 23 and rail 23*a* in the B direction.

In the case of opening and closing operation of the circuit breaker, spring shaft 22 rotates in the B direction under the control of a catch which is not illustrated. Contacts in a breaker unit (not shown) of the circuit breaker are opened and closed through a force transmission mechanism (not shown) by the rotation of spring shaft 22 as is well known to those skilled in the art. The opening operation is completed in FIGS. 11(*a*)→11(*b*), and the closing operation is completed in FIGS. 11(*b*)→11(*c*).

At the end of the opening and closing operation as shown in FIG. 11(*c*), the leading end of peg 24 is on the same plane as the outer peripheral surface of end-plate disc 20*b*. The switching of a microswitch (not illustrated) is performed by pushing up release/store control lever 25 which is supported by a pin 26 so that it is free to rotate. This microswitch is provided for switching ON or OFF a spring energy storing motor.

Due to the switching of the microswitch (not illustrated), rotating spring 21 which has become in the energy-released state, starts to store energy through spring case 20 being rotated in the C direction by a spring energy storing motor (not illustrated).

During the rotation of spring case 20, release/store control lever 25 makes sliding contact on end-plate disc 20*b*. At the same time, peg 24 performs a rotating motion in the C direction together with spring case 20. Thus peg 24 moves toward the center of spring shaft 22 along rail 23*a*.

At the end of the energy storing of rotating spring 21 as shown in FIG. 11(*a*), peg 24 is positioned at Eo, and release/store control lever 25 is in contact with parallel guides 20*a*.

The detail of the operating mechanism of the circuit breaker as described above is disclosed in French Patent No. 88-10943 published on Aug. 17, 1988.

Control of the microswitch, which is the switch for the spring energy storing motor (not illustrated), is performed by using the motions of release/store control lever 25 due to this series of actions.

However, in this type of circuit breaker, there is a position in which sliding contact is made. Therefore, wear of parts though frequent actions is unavoidable. Consequently, inspection and maintenance, such as greasing, becomes vital, and reliability is reduced.

Also, the number of parts in the operating mechanism is large and this results in complex construction.

SUMMARY OF THE INVENTION

Accordingly, one object of this invention is to provide an operating mechanism for a circuit breaker in which reliability is improved for frequent operations with a simple construction.

Another object of this invention is to provide an operating mechanism for a circuit breaker which can detect the discharge and charge states of a rotating spring accurately with a simple construction.

These and other objects of this invention can be achieved by providing an operating mechanism for a circuit breaker including a frame, a spring shaft mounted on the frame and rotatable around a central axis thereof, a spring case having a notch in an outer periphery thereof and rotatable around the central axis, a rotating spring provided in the spring case and having a first end secured to the spring shaft and a second end secured to the spring case, a cam secured to the spring shaft and rotatable along with the spring shaft, and a catch rotatably mounted on the spring case. The catch is at an original position at the notch inside the outer periphery of the spring case by a spring. The operating mechanism further includes a charging device for rotating the spring case to charge the rotating spring and a control lever rotatably mounted on the frame and having an end portion engaged with the cam, the catch and the outer periphery of the spring case for performing closing and opening control of the charging device. The control lever takes a first position where the end portion of the control lever is at an surface of the outer periphery of the spring case and a second position where the end portion of the control lever is inside the outer periphery of the spring case. The spring shaft is rotated by a driving force of the rotating spring for causing the end portion of the control lever to engage with the cam, thereby to move the control lever from the second position to the first position by the rotation of the cam and to cause the control lever to perform the closing control of the charging device when the control lever is at the first position. The spring case is rotated by the charging device to charge the rotating spring, for causing the end portion of the control lever to be in rolling contact with the surface of the outer periphery of the spring case till the end portion is engaged with the catch and falls inside the outer periphery from the notch, thereby to move the control lever from the first position to the second position by the rotation of the spring case and to cause the control lever to perform the opening control of the charging device when the control lever is at the second position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
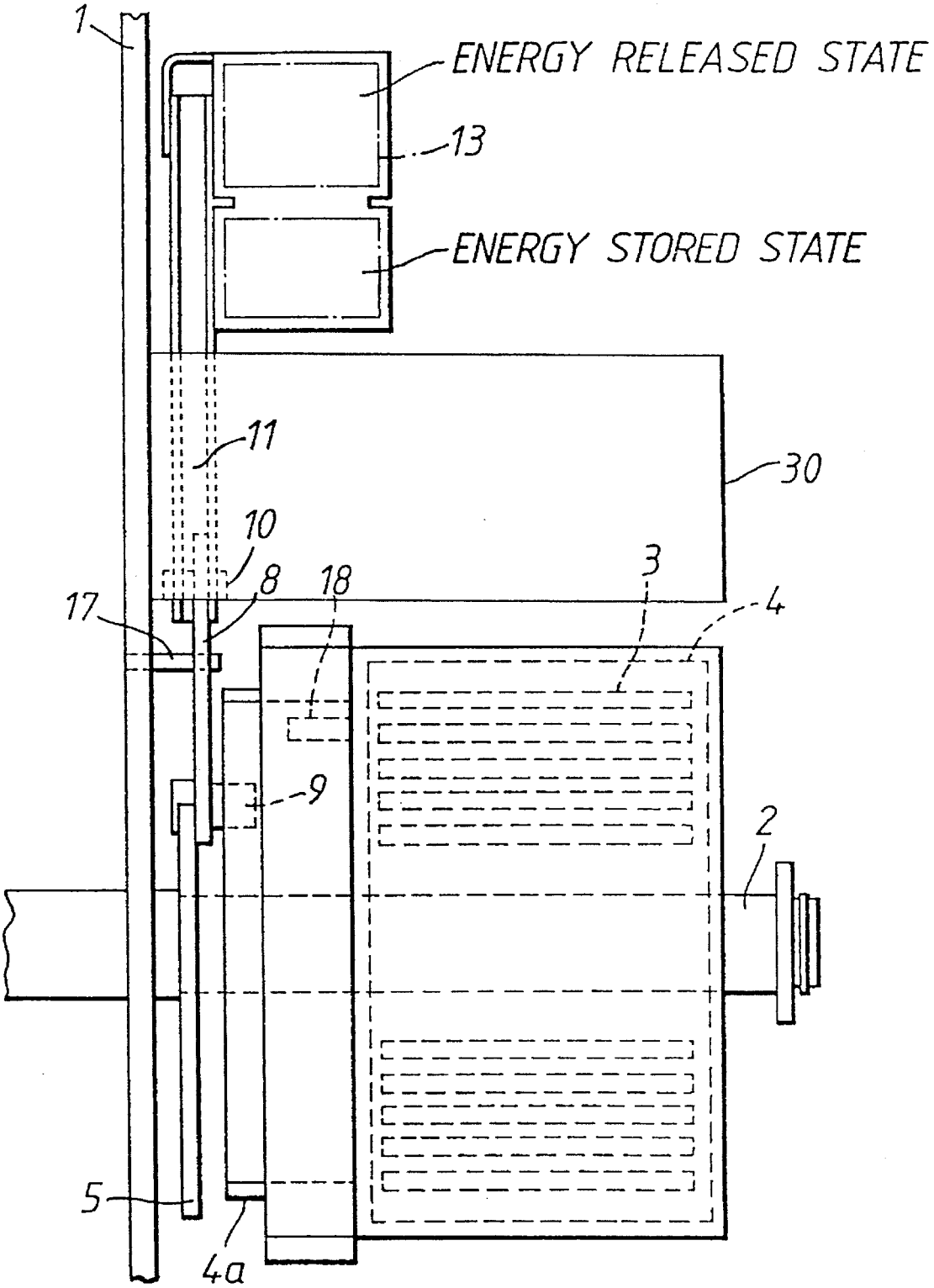
FIG. 1 is an enlarged front elevation of the essential parts of an operating mechanism of a circuit breaker according to an embodiment of this invention.

Referring now to the drawings, wherein like reference numerals designate identical or corresponding parts throughout the several views, the embodiments of this invention will be described below.

Figure 2:
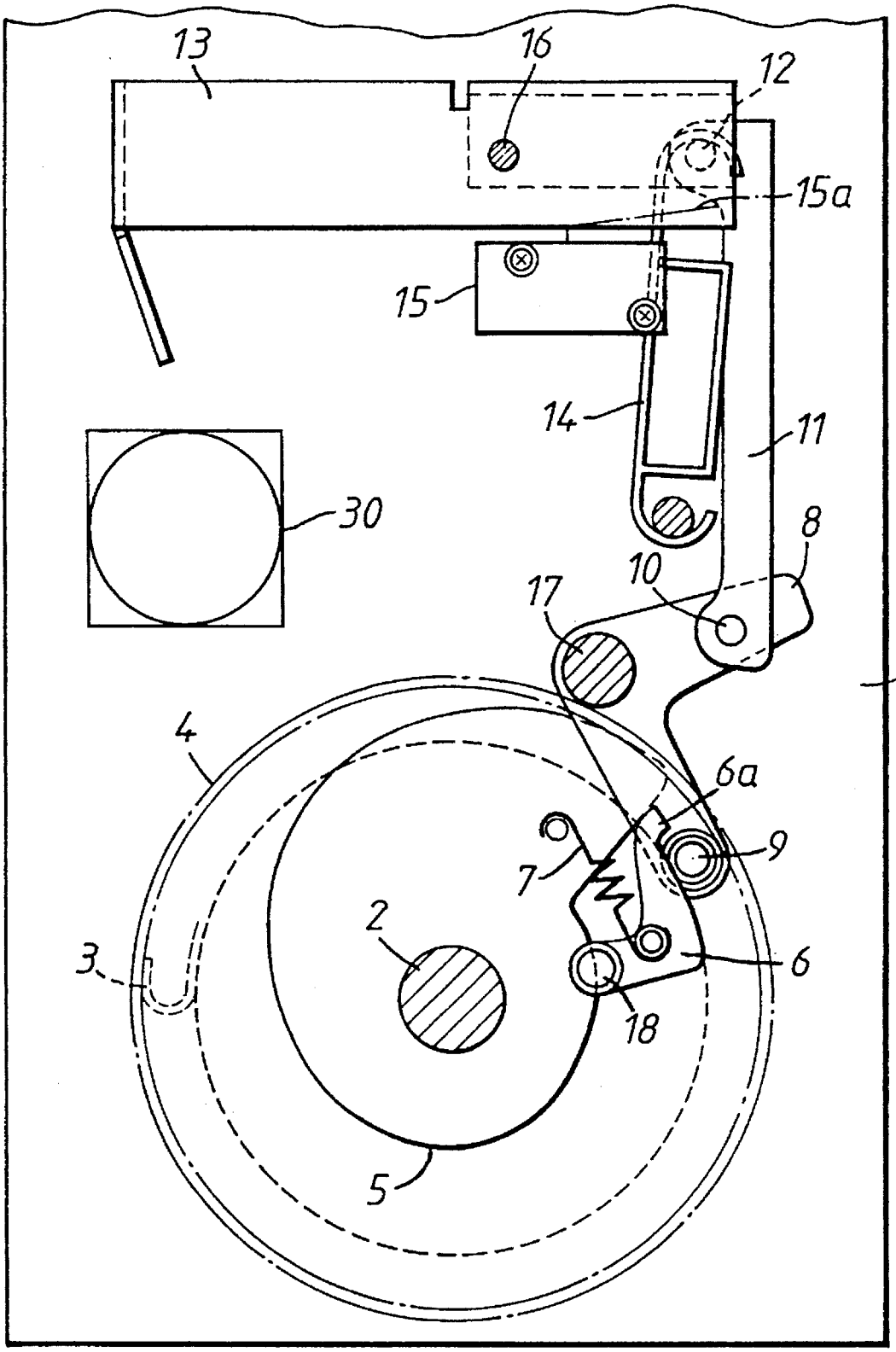
FIG. 2 is an enlarged side elevation of the essential parts shown in FIG. 1.

FIG. 1 is an enlarged front elevation of the essential parts of an operating mechanism of a circuit breaker according to an embodiment of this invention. FIG. 2 is an enlarged side elevation of the essential parts shown in FIG. 1.

In these drawings, the inner end of a rotating spring 3 which is an energy source is secured to a spring shaft 2, and the outer end thereof is secured to a spring case 4. A cam 5 is secured to spring shaft 2.

Figure 3:
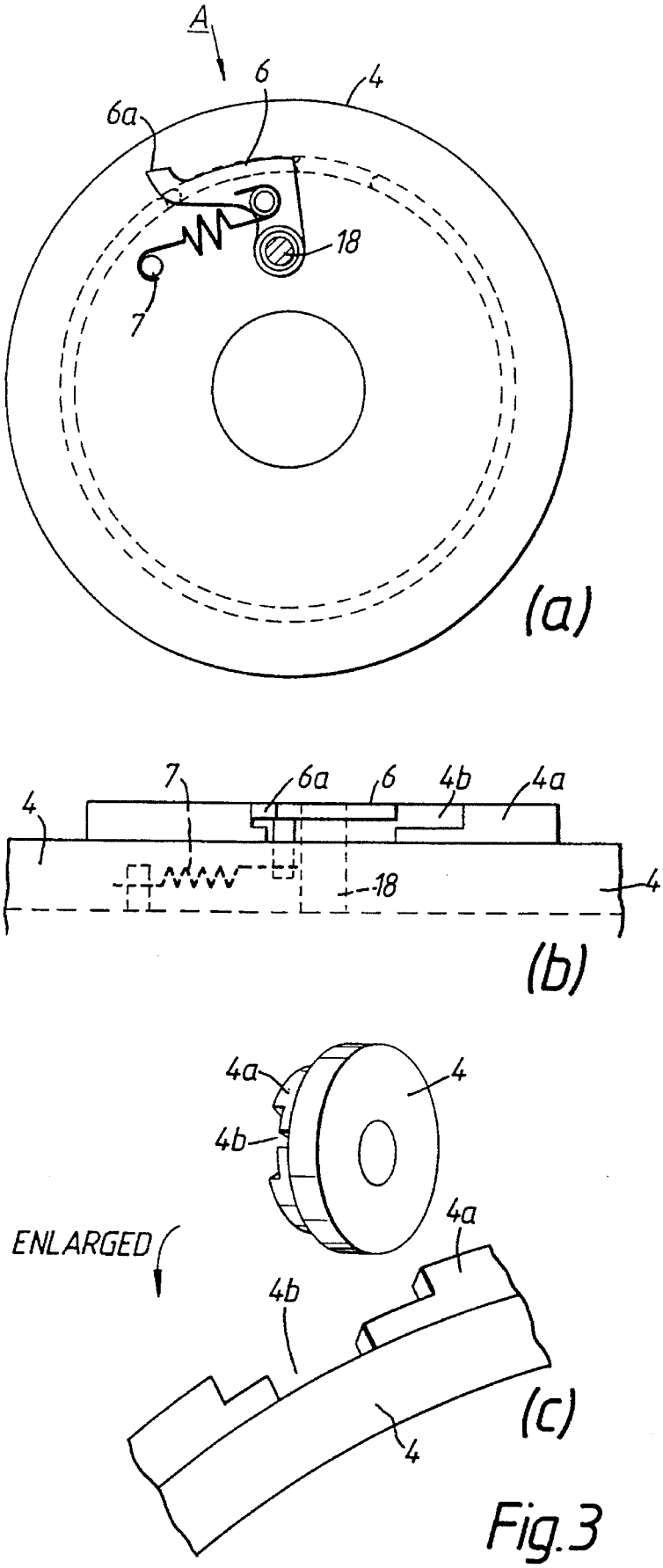
FIG. 3 is a drawing showing the construction of spring case 4 in FIG. 2.

FIG. 3 shows the construction of spring case 4, wherein (a) is a front elevation of spring case 4, (b) is a plan view of spring case 4 in the direction of an arrow A in FIG. 3(*a*), and (c) is a perspective view of spring case 4.

As shown in FIG. 3, a notch 4*b* is provided on part of an outer periphery 4*a* of spring case 4. A catch 6 is provided inside outer periphery 4*a* and is mounted by a pin 18 recured on spring case 4 such that the outer periphery of catch 6 is on the same plane as the surface of outer periphery 4*a* of spring case 4. Catch 6 performs rotational motion about pin 18 inside outer periphery 4*a*, but catch 6 returns to its original position by being engaged in notch portion 4*b* of spring case 4 by a return spring. A tip portion 6*a* of catch 6 projects from outer periphery 4*a* in the direction of the radius of spring case 4.

Figure 8:
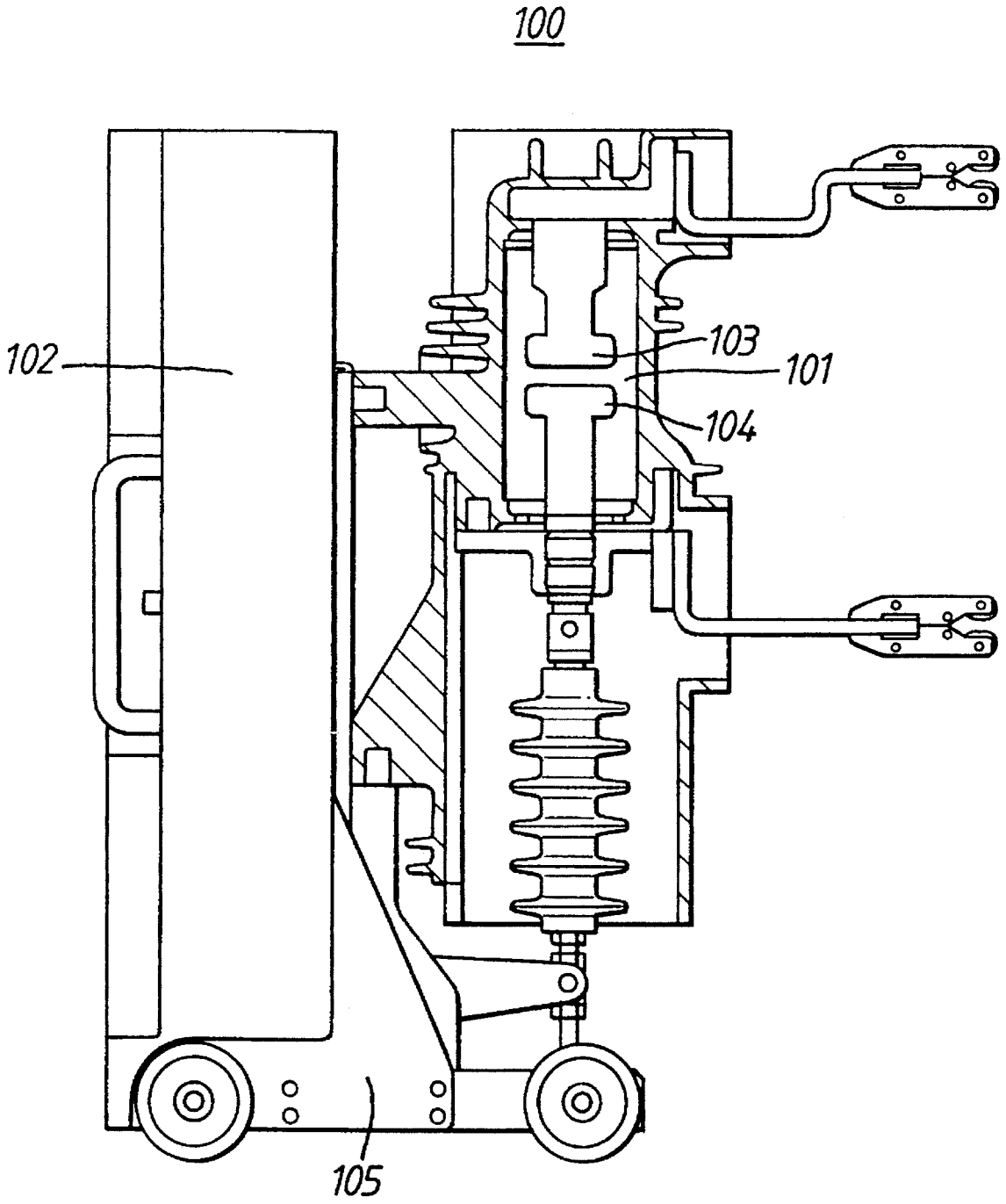
FIG. 8 is a cross section showing the construction of a typical vacuum circuit breaker.
Figure 9:
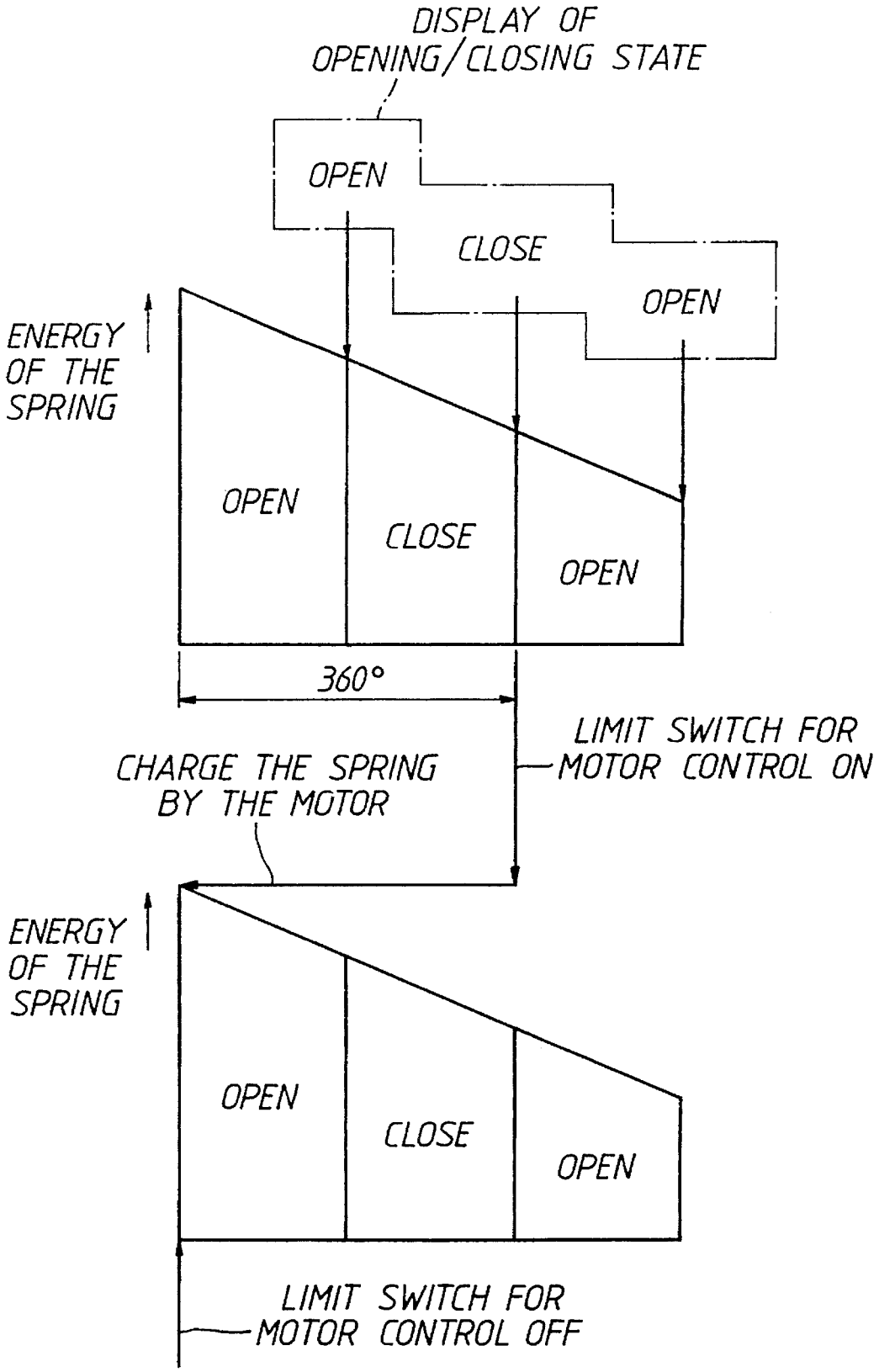
FIG. 9 is a view to illustrate the relation of the control of an electric motor for charging a spring and the opening/closing operation of the contacts in a vacuum circuit breaker shown in FIG. 8.
Figure 10:
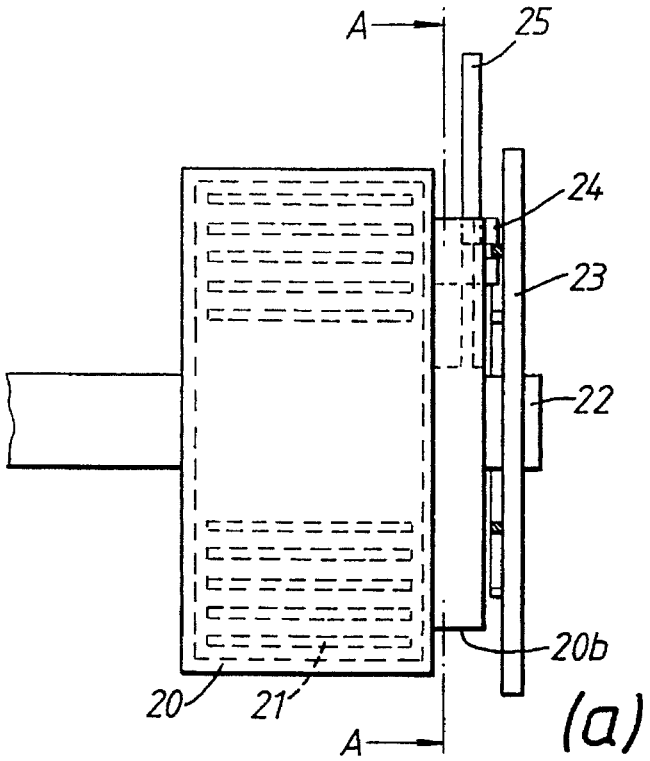
Fig.10 (PRIOR ART)
FIG. 10 is an enlarged drawing of the essential parts of an operating mechanism of a conventional typical circuit breaker.
Figure 10:
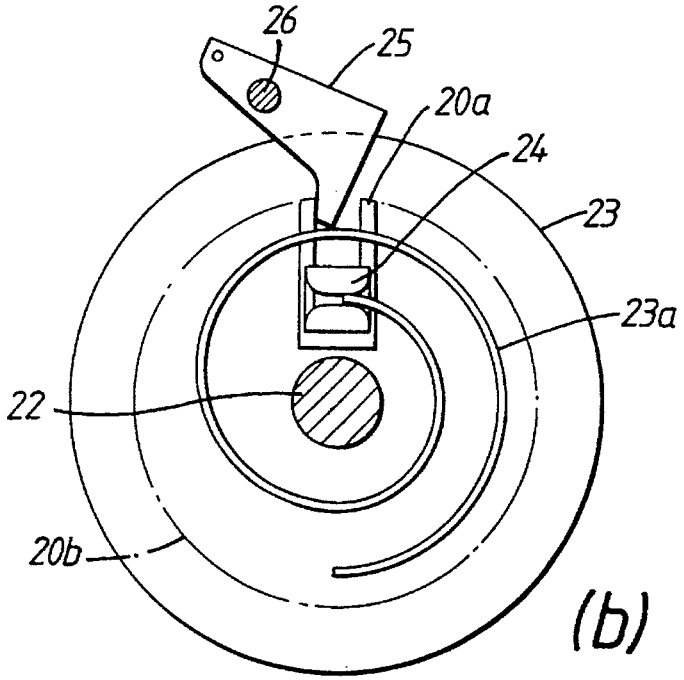
Fig.10 (PRIOR ART)
Figure 11:
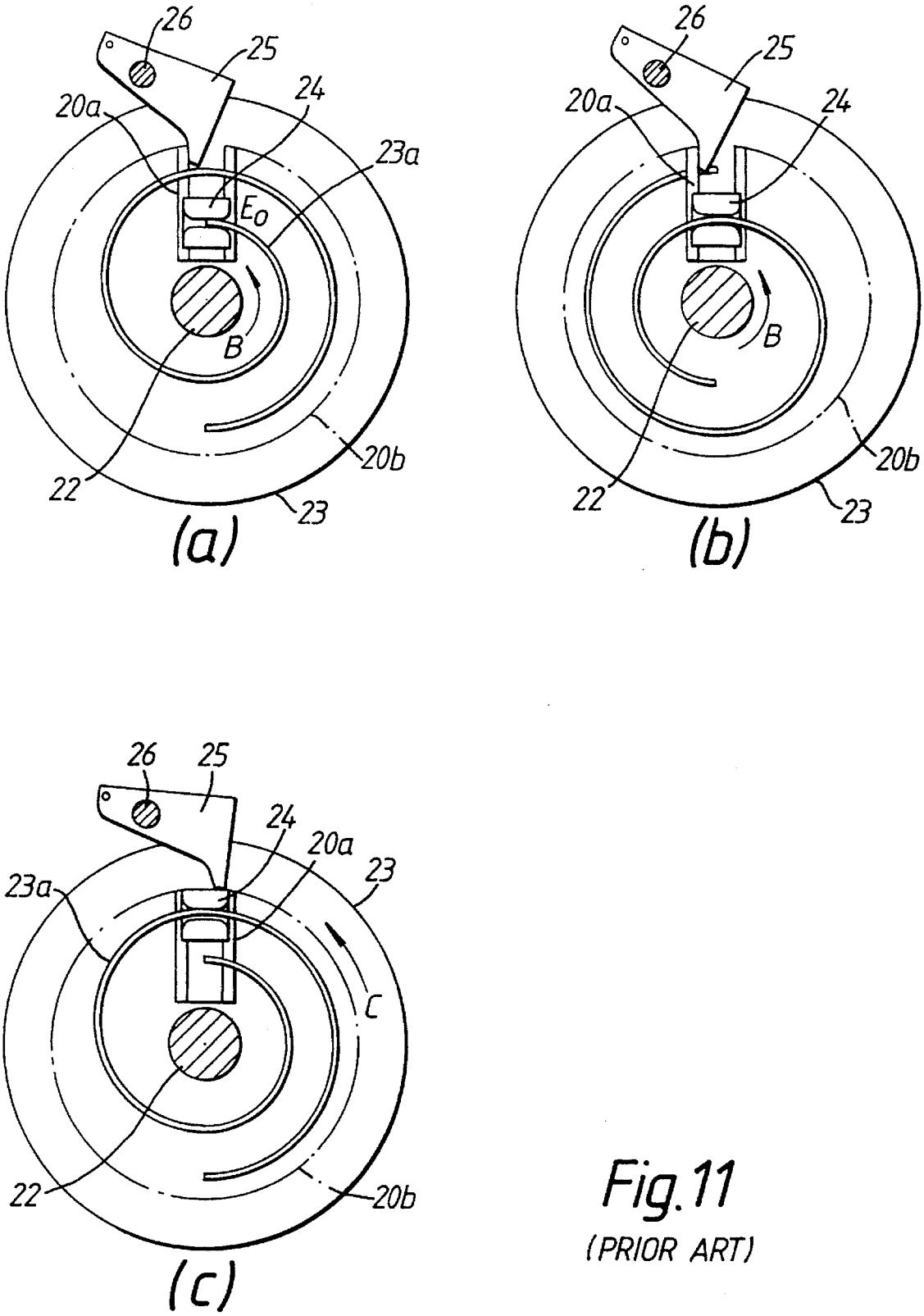
Fig. 11 (PRIOR ART)
FIG. 11 is a drawing to illustrate the action of an operating mechanism of a typical circuit breaker shown in FIG. 10.

A release/store control lever 8 is mounted on a frame 1 of the circuit breaker by a pin 17 so that it is free to rotate, and performs rotational motion about pin 17. Spring shaft 2 is connected to operating lever 106 (FIG. 8) of the circuit breaker in the well-known manner such as illustrated in U.S. Pat. No. 4,996,397 (drive shaft 28) and U.S. Pat. No. 4,439,653 (shaft 11) to thereby open or close contacts 103 and 104. In this respect, in the prior art circuit breaker shown in FIGS. 10(*a*) and 10(*b*), spring shaft 22 is connected to operating lever 106 and functions the same as spring shaft 2 of this invention. A pin 9 is linked to the leading end of release/store control lever 8. Pin 9 and outer peripheral surface 4*a* of spring case 4 make rolling contact with each other. One end of a rod 11 is linked to the other end of release/store control lever 8 by a pin 10. A display 13 is mounted on frame 1 by a pin 16 so that it is free to rotate. One end of display 13 is linked to the other end of rod 11 by a pin 12. Also, a return spring 14 is mounted on display 13 for maintaining contact between pin 9 and outer peripheral surface 4*a* of spring case 4 by always applying a unidirectional force to pin 9 via rod 11 and release/store control lever 8. Furthermore, a microswitch 15 which performs control of an energy storing motor (not illustrated) is secured to frame 1, and performs the switching of a lever 15*a* of microswitch 15 by pin 12.

Figure 4:
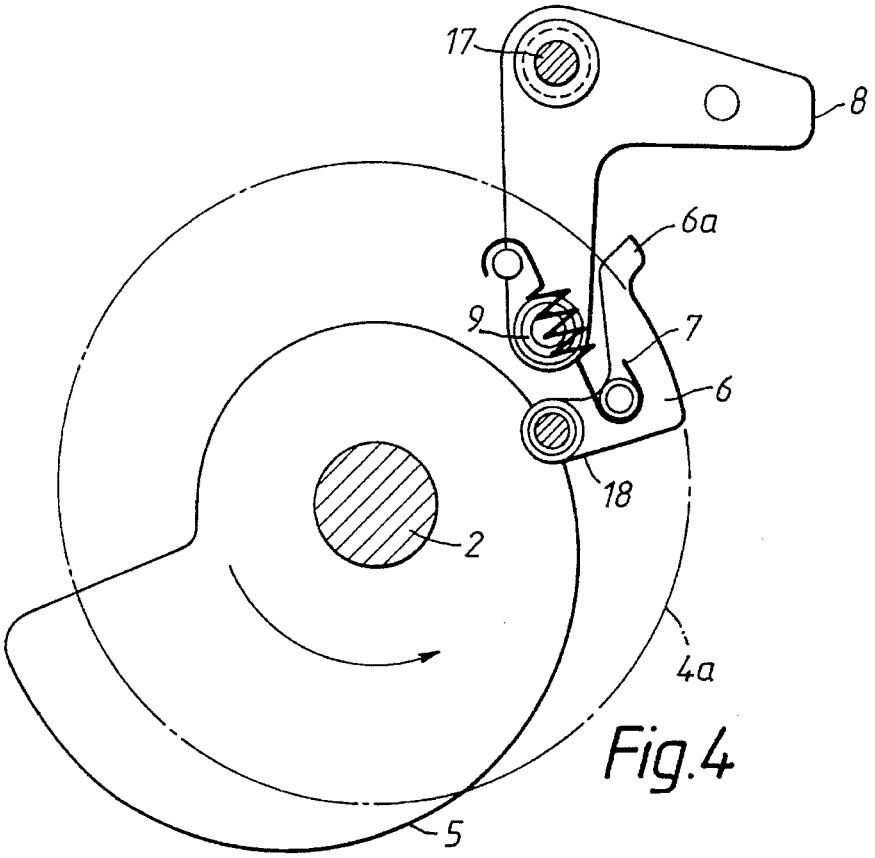
FIG. 4 is a drawing showing the charging state of an operating mechanism of a circuit breaker shown in FIG. 1.
Figure 5:
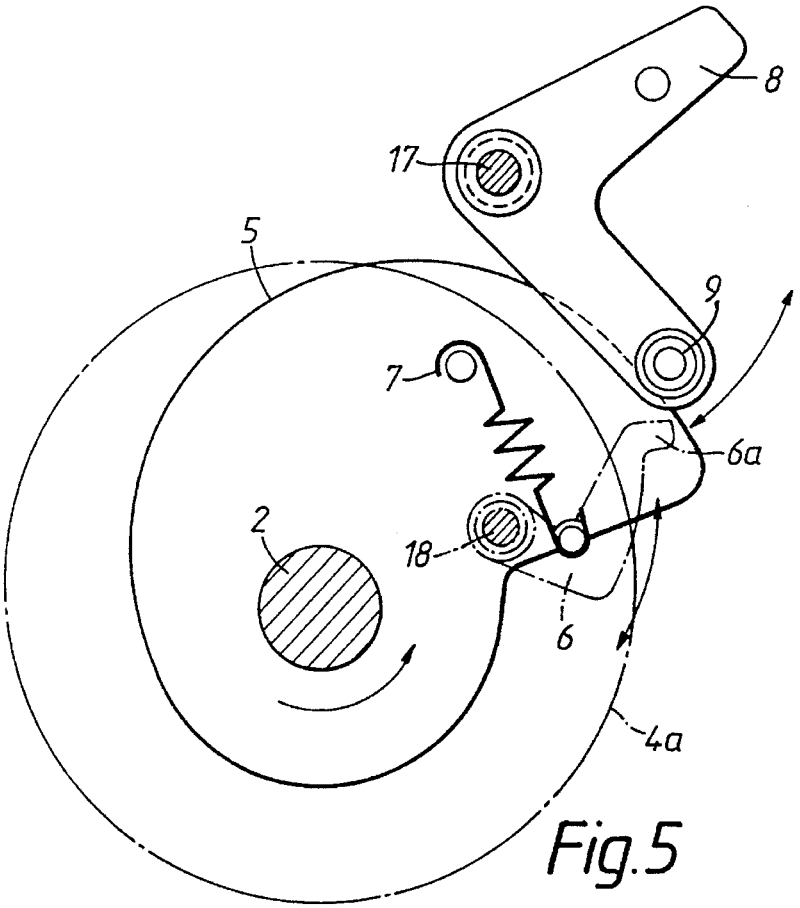
FIG. 5 is a drawing showing the discharging state from the charging state of an operating mechanism of a circuit breaker shown in FIG. 1.
Figure 6:
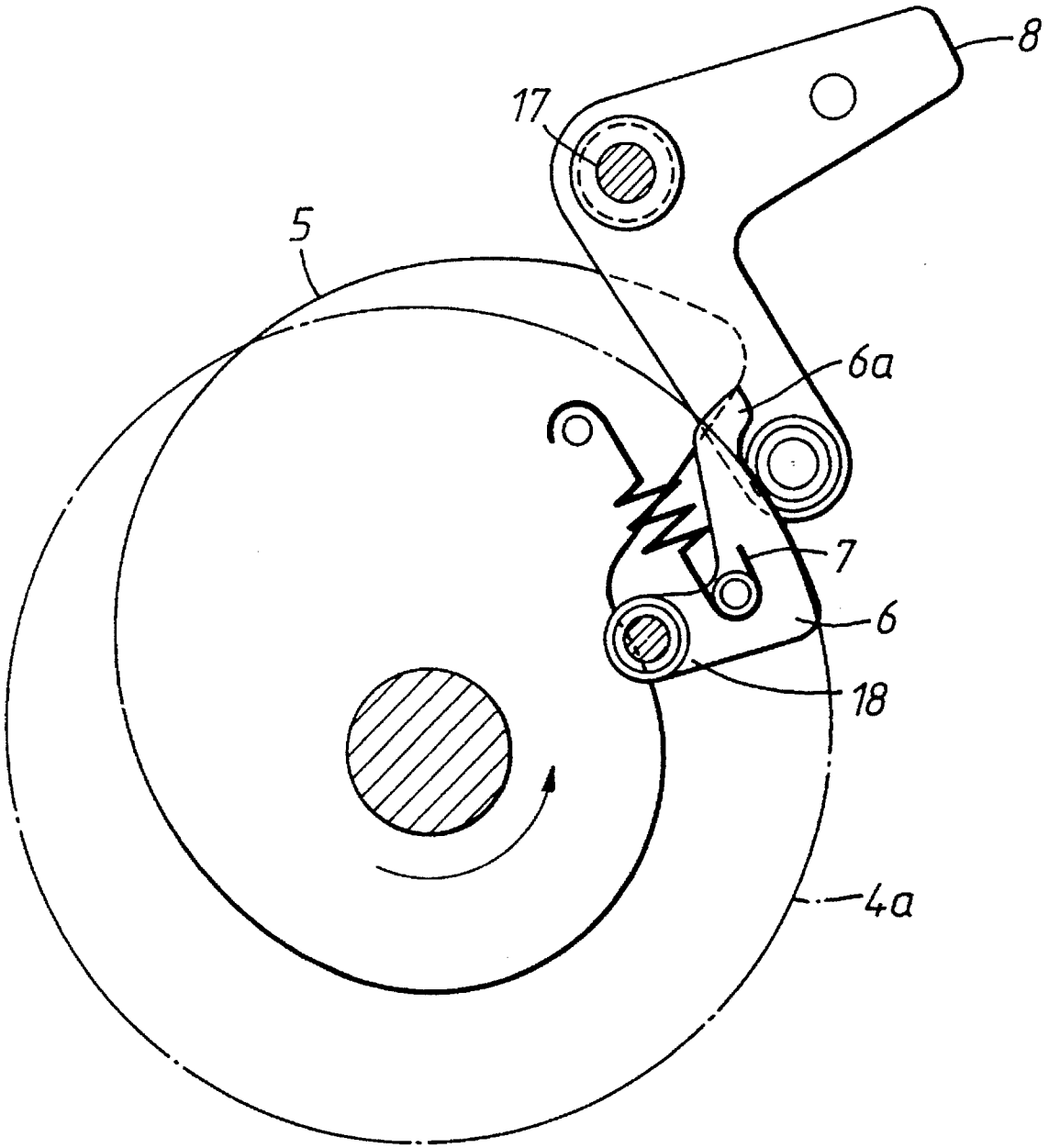
FIG. 6 is a drawing showing the discharging state of an operating mechanism of a circuit breaker shown in FIG. 1.

The following is a description of the operation of rotating spring 3 from the energy stored state to the energy released state with reference to FIGS. 4 to 6. As shown in FIG. 4, cam 5 is positioned on spring shaft 2 and performs rotational motion along with spring shaft 2 about the central axis of spring shaft 2 by the opening and closing operations of the circuit breaker. Also, as shown In FIG. 5, before the completion of closing the circuit breaker, cam 5 pushes up pin 9 which is linked to release/store control lever 8, thereby pin 9 causes catch 6 to rotate clockwise. Then, as shown in FIG. 6, pin 9 disengages from catch 6 at the position where release/store control lever 8 was pushed up, and catch 6 is returned to its original position by return spring 7. After this, at the completion of closing, cam 5 and pin 9 disengage, thereby release/store control lever 8 is returned to the position on outer peripheral surface 4*a* of spring case 4 by catch 6. At this time, display 13 displays "the energy-released state" Via rod 11. Also, microswitch 15 becomes in the "Closed" state using the vertical motion of rod 11. Furthermore, the charging of rotating spring 3 is performed by the rotation of spring case 4 caused by the action of an energy storing motor 30. Suitable reduction gearing rotatably connects the motor 30 to the spring case 4 in the well-known manner. See, for example, U.S. Pat. No. 4,996,397 which shows such a motor 84 driving a reduction gear 86.

Figure 7:
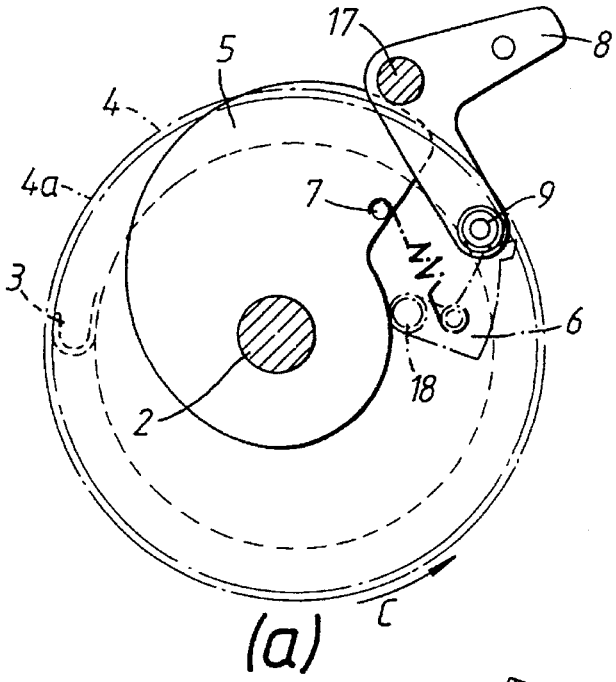
FIG. 7 is a drawing showing the charging completion state from the charging state of an operating mechanism of a circuit breaker shown in FIG. 1.
Figure 7:
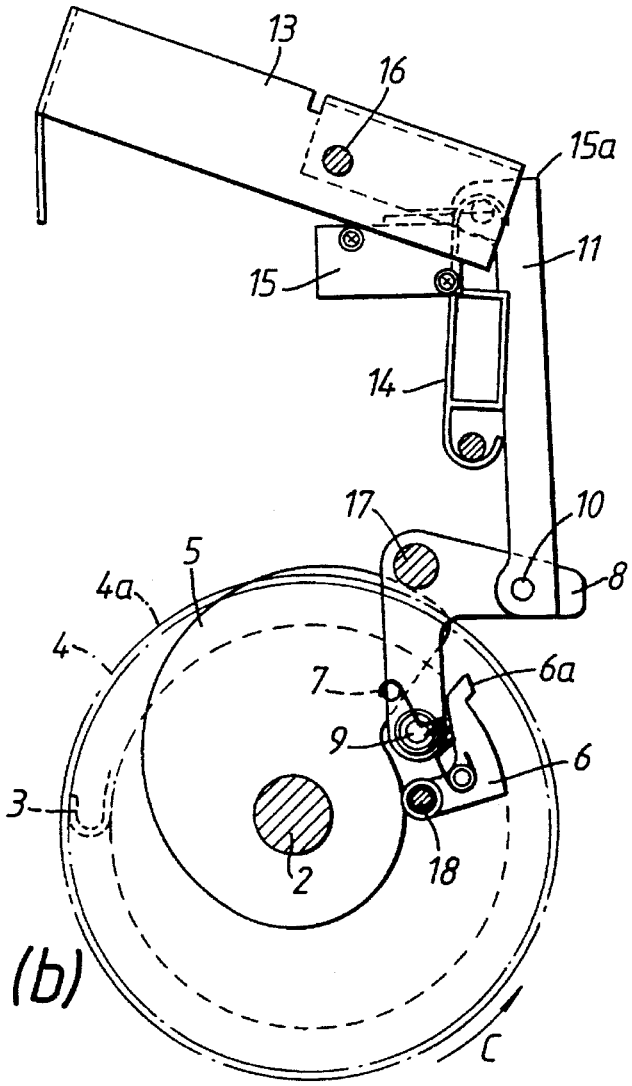

Next, the action until completion of the charging of rotating spring 3 is described. During the charging of rotating spring 3, spring case 4 along with outer periphery 4*a* rotates in the direction C as shown in FIG. 7(*a*), and pin 9 secured to release/store control lever 8 makes rolling contact on outer peripheral surface 4*a* of spring case 4 by return spring 14. At this time, display 13 shows "the energy-released state". As shown in FIG. 7(*a*), as tip portion 6*a* of catch 6 rotates in the direction C along with spring case 4, pin 9 and tip portion 6*a* make contact immediately before completion of the charging of rotating spring 3. Catch 6 is then pushed upward in the clockwise direction.

After this, on completion of charging, since there is a notch 4*b* in outer peripheral surface 4*a* of spring case 4, pin 9 which has been in rolling contact on outer peripheral surface 4*a*, disengages from catch 6, and is instantly moved toward the inside of spring case 4 by return spring 14, display 13 displays "the energy-stored state" via rod 11, as shown in FIG. 7(*b*). Also, pin 12 presses down lever 15*a* of microswitch 15. Thus microswitch 15 becomes in the "Open" state to stop operation of the energy-storing motor (not illustrated), thereby to complete energy storing.

When using this embodiment described above, simplified construction of an operating mechanism of a circuit breaker can be achieved and, at the same time, the sliding contact point can be eliminated. Thus, reliability can be improved by reducing the requirement for inspection and maintenance.

As described above, according to this invention an operating mechanism for a circuit breaker can be obtained in which reliability is improved for frequent operations with a simple construction.

Furthermore, according to this invention an operating mechanism for a circuit breaker can be obtained which can detect the discharge and charge states of a rotating spring accurately with a simple construction.

Obviously, numerous modifications and variations of the present invention are possible in light of the above teachings. It is therefore to be understood that within the scope of the appended claims, the invention may be practiced otherwise than as specifically described herein.

What is claimed is:

1. An operating mechanism for a circuit breaker, comprising:

a frame;

a spring shaft mounted on said frame and rotatable around a central axis thereof;

a spring case having a notch in an outer periphery thereof and rotatable around said central axis;

a rotating spring provided in said spring case and having a first end secured to said spring shaft and a second end secured to said spring case;

a cam secured to said spring shaft and rotatable along with said spring shaft;

a catch rotatably mounted on said spring case, said catch being at an original position at said notch inside said outer periphery of said spring case by a spring;

charging means for rotating said spring case to charge said rotating spring; and control lever means rotatably mounted on said frame and having an end portion engaged with said cam, said catch and said outer periphery of said spring case for performing closing and opening control of said charging means;

said control lever means taking a first position where said end portion of said control lever means is at a surface of said outer periphery of said spring case and a second position where said end portion of said control lever means is inside said outer periphery of said spring case;

said spring shaft being rotated by a driving force of said rotating spring for causing said end portion of said control lever means to engage with said cam, thereby to move said control lever means from said second position to said first position by the rotation of said cam and to cause said control lever means to perform said closing control of said charging means when said control lever means is at said first position; and said spring case being rotated by said charging means to charge said rotating spring, for causing said end portion of said control lever means to be in rolling contact with said surface of said outer periphery of said spring case till said end portion is engaged with said catch and falls inside said outer periphery from said notch, thereby to move said control lever means from said first position to said second position by the rotation of said spring case and to cause said control lever means to perform said opening control of said charging means when said control lever means is at said second position.

2. The operating mechanism for a circuit breaker according to claim 1, wherein:

said spring shaft is rotated by a driving force of said rotating spring for causing said end portion of said control lever means to engage with said cam;

said control lever means rotates for causing said catch to rotate in a direction opposite to a tension force of said spring;

said control lever means disengages with said catch when a tip portion of said catch is outside of said notch of said outer periphery of said spring case, and said catch returns to said original position;

said end portion of said control lever means is at said surface of said outer periphery of said spring case;

thereby to move said control lever means from said second position to said first position by the rotation of said cam and to cause said control lever means to perform said closing control of said charging means when said control lever means is at said fist position.

3. The operating mechanism for a circuit breaker according to claim 1, wherein:

said charging means includes an electric motor for rotating said spring case to charge said rotating spring; and said electric motor is started its operation when said control lever means performs said closing control and is stopped its operation when said control lever means performs said opening control.

4. The operating mechanism for a circuit breaker according to claim 1, wherein:

said control lever means includes, a first pin mounted on said frame, a lever rotatable around said first pin, and a second pin rotatably mounted on an end of said lever;

said second pin engages with said cam, said catch and said outer periphery of said spring case.

5. The operating mechanism for a circuit breaker according to claim 1, further comprising:

a display unit driven by said control lever means for displaying discharge and charge states of said rotating spring;

said display unit displaying said charge state when said control lever means performs said opening control of said charging means; and said display unit displaying said discharge state when said control lever means performs said closing control of said charging means.

* * * * *